United States Patent [19]

Koji

[11] Patent Number: 4,977,634

[45] Date of Patent: Dec. 18, 1990

[54] PILLOW WITH POISONOUS GAS REMOVING COVER

[76] Inventor: Seinosuke Koji, 596-1 Ooaza Tokida, Tohbu-machi, Chisagata-gun, Nagano 389-05, Japan

[21] Appl. No.: 415,107

[22] Filed: Sep. 29, 1989

[51] Int. Cl.[5] ..... A47G 9/00; A62B 7/10

[52] U.S. Cl. ..... 5/434; 5/90; 55/316; 55/DIG. 35; 128/205.27

[58] Field of Search ..... 5/434, 435, 436, 490, 5/461; 128/205.27, 205.28, 205.29; 55/316, DIG. 35

[56] References Cited

U.S. PATENT DOCUMENTS

| | | | |
|---|---|---|---|
| 3,240,567 | 3/1966 | Caparelli et al. | 128/205.28 |
| 3,616,470 | 11/1971 | Young et al. | 5/435 |
| 4,382,440 | 5/1983 | Kapp et al. | 128/205.28 |
| 4,523,588 | 6/1985 | Dolsky | 5/434 |

FOREIGN PATENT DOCUMENTS

| | | | |
|---|---|---|---|
| 55-14658 | 4/1980 | Japan . | |
| 62-174 | 4/1987 | Japan | 128/205.27 |
| 63-255075 | 10/1988 | Japan . | |

*Primary Examiner*—Alexander Grosz

*Attorney, Agent, or Firm*—Birch, Stewart, Kolasch & Birch

[57] ABSTRACT

A lifesaving pillow uses a flexible and air-permeable antigas sheet member including a poisonous gas removing layer containing an antigas agent for removing poisonous gas and, if necessary, a deodorizing layer containing a deodorizing agent and a smoke filtering layer for filtering smoke as a pillow bag or a detachable pillow cover which is an outside element of the pillow. The lifesaving pillow can be used as an ordinary pillow and further can be utilized as a mask or a self-defensive device having an antigas function by a user putting it over the nose or mouth when a fire occurs.

8 Claims, 2 Drawing Sheets

PILLOW WITH POISONOUS GAS REMOVING COVER

BACKGROUND OF THE INVENTION

1. Field of the Invention

The present invention relates to a device for protecting a person from gas or smoke inhalation damage during a fire and, more particularly, to means associated with a pillow for this purpose.

2. Description of the Related Art

Generally, sleeping accommodations, such as hotels or hospitals, are provided with a fire extinguishing apparatus, such as a sprinkler and a fire extinguisher. In addition, it is the usual practice to provide an alarm device and some guidance as to how the structure should be evacuated in case of a fire.

Many deaths in a hotel fire are the result of the inhaling of poisonous gases, generated by the burning building materials, which are encountered when the occupants are attempting to evacuate the building. In this regard, there is no effective countermeasure currently being used which can be used as an effective defense against the poisonous gases.

Heretofore, one technique used in self-defense is a gas mask. However, it is not easy to use the gas mask because the gas mask has only a simple antigas function, it must be serviced and its presence insured if the gas mask is provided in a required place, and it is difficult to use immediately in an emergency.

Japanese Patent Publication No. 55-146558 discloses antigas wearing apparel as a self-defense device to be worn on a person's body. This type of antigas wearing apparel exhibits resistance against poisonous material and is non-permeable. It comprises an external layer made of material having flexibility and relative rigidity and an exchangeable internal layer made of a porous filter having a poisonous material removing agent. Further, the antigas wearing apparel is provided with a ventilation portion, disposed in the external layer in the portion covered by the porous filter, which can communicate with the outside air. Accordingly, an effective defense relative to fire will not be provided by this special wearing apparel.

SUMMARY OF THE INVENTION

It is an object of the present invention to provide a lifesaving pillow which can provide effective self-defense from poisonous gas generated by a fire and, thus greatly contribute to the saving of life.

It is another object of the present invention to provide a lifesaving pillow with extremely high practicality which is kept by a user's side and can be used immediately when a fire occurs suddenly at night and can be utilized properly and immediately in an emergency even by children and elderly persons because of simple manner of its use.

It is a further object of the present invention to provide a lifesaving pillow which performs excellently as a lifesaving device having multiple functions and which can be utilized as a self-protection device in the event of an evacuation.

In order to achieve the above object, a lifesaving pillow 1 according to the present invention is characterized by the provision of a flexible and air-permeable antigas sheet member 2 including a poisonous gas removing layer 3 containing therein an antigas agent which removes poisonous gas and, if desired or necessary, a deodorizing layer 4 containing a deodorizing agent and a smoke filtering layer 5 for filtering smoke, the antigas sheet member 2 being used as the pillow case 11 for a pillow itself, a bag 12 for the pillow or a detachable pillow cover 13.

Accordingly, the lifesaving pillow 1 can be used as an ordinary pillow and when necessary can be utilized as a mask having an antigas function or as a self-defense device by putting the pillow 1 over a nose or mouth when a fire occurs.

DETAILED DESCRIPTION OF THE PREFERRED EMBODIMENTS

Preferred embodiments according to the present invention will now be described in detail with reference to the drawings.

Figure 2:
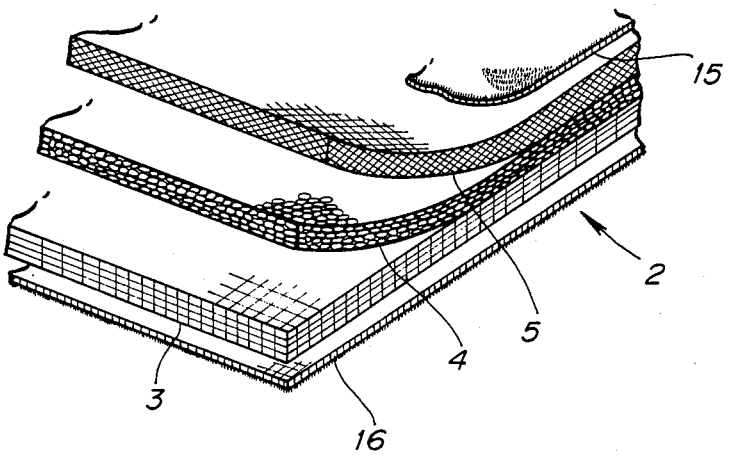
FIG. 2 is an enlarged exploded view of a circle A of FIG. 1.
Figure 3:
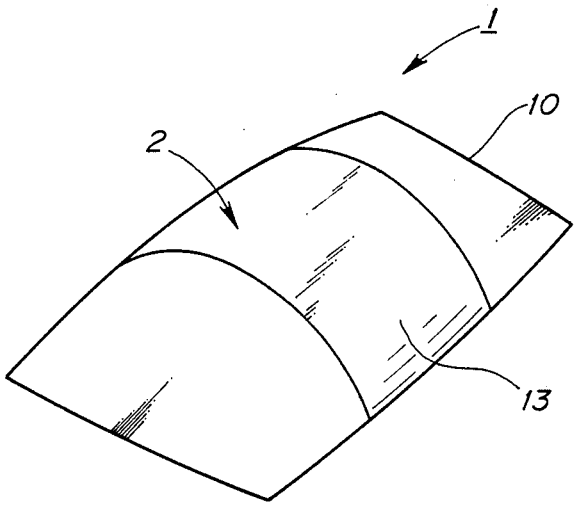
FIG. 3 is a perspective view of a lifesaving pillow according to another embodiment of the present invention.

The lifesaving pillow 1 comprises a pillow bag 12 made of an antigas sheet member 2. The antigas sheet member 2 comprises a core portion formed of three layers as shown in FIG. 2. The first layer is a smoke filtering layer 5 which filters out smoke by utilizing a smoke filter, the second layer is a deodorizing layer 4 containing a deodorizing agent such as activated charcoal and chlorophyll, and the third layer is a poisonous gas removing layer 3 containing an antigas agent, which is a mixture of a gas absorption agent such as activated charcoal and felt and an auxiliary agent such as soda-lime. The core portion formed of the three layers is covered by cloth material 15 and 16 which are agreeable to the touch in order to form a soft feeling antigas sheet member 2. The antigas sheet member 2 may comprise only the poisonous gas removing layer 3 which has the function of removing poisonous gas. The smoke filtering layer 5 and the deodorizing layer 4 which is a layer including a purification agent for purifying air may be provided if desired or necessary. Further, another layer having another function can be added if desired or necessary.

Figure 1:
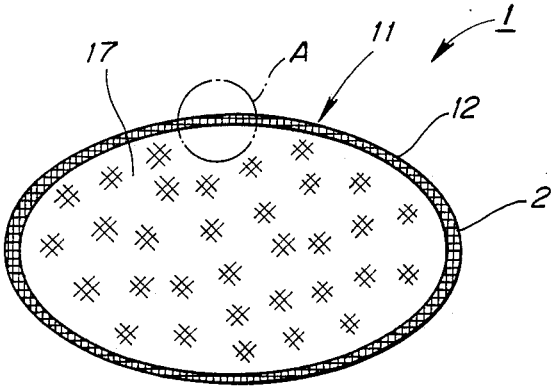
FIG. 1 is a longitudinal sectional view of a lifesaving pillow according to the present invention.

The antigas sheet member 2 is subjected to cutting and sewing so that a pillow bag 12 forming an external casing 11 of the pillow is formed as shown in FIG. 1. The pillow bag 12 is filled with a filler 17, such as buckwheat chaff and cotton, in the same manner as an ordinal pillow so that the lifesaving pillow 1 is provided with ventilation.

The lifesaving pillow 1 according to the present invention is used in the following manner. Initially it is noted that the lifesaving pillow 1 can be used by everyone, including guests in a hotel and patients in a hospital in the same manner as an ordinary pillow in the absence of a fire.

Figure 4:
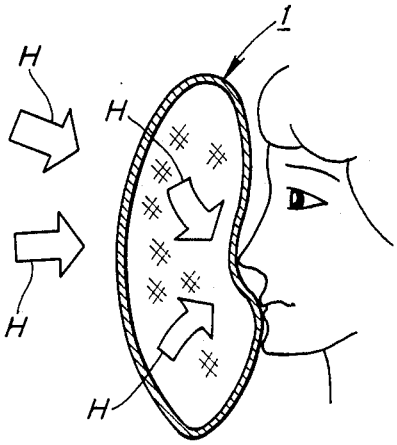
FIG. 4 illustrates a used state of a lifesaving pillow according to the present invention.

When a fire takes place at night and a situation requiring immediate evacuation occurs, the lifesaving pillow 1 which has been used in bed can be utilized as a mask having an antigas function by putting the pillow 1 over the nose or mouth as is as shown in FIG. 4. Thus, the air passing through the pillow 1, as shown by arrow H, is purified by the antigas effect, the smoke removing effect and the deodorizing effect of the antigas sheet member 2. Further, since the lifesaving pillow 1 can be carried during the evacuation, the pillow 1 can be put on the head when there is no smoke and poisonous gas present and utilized as a device to provide protection against falling objects.

The lifesaving pillow 1 according to the present invention can be provided near a sleeping person and can be used easily by anyone, even though they have not previously used the lifesaving pillow. The lifesaving pillow may include an antigas function portion formed by several layers of the antigas sheet member 2.

The present invention being thus described, it will be obvious that the same may be varied in many ways. Such variations are not to be regarded as a departure from the spirit and scope of the invention, and all such modification as would be obvious to one skilled in the art are intended to be included within the scope of the following claims.

I claim:

1. A lifesaving pillow comprising filler material, a member located around said filler material, said member being formed of flexible and air-permeable sheet material, and said sheet material including a poisonous gas removing layer containing an antigas agent for removing poisonous gas.

2. A lifesaving pillow as recited in claim 1, in which said member completely encloses said filler material.

3. A lifesaving pillow as recited in claim 1, in which a cover encloses said filler material and said member is located around both said filler material and said cover.

4. A lifesaving pillow as recited in claim 1, in which said sheet material also includes a deodorizing layer containing a deodorizing agent.

5. A lifesaving pillow as recited in claim 1, in which said sheet material also includes a smoke filtering layer for filtering smoke.

6. A lifesaving pillow as recited in claim 5, in which said sheet material also includes a deodorizing layer containing a deodorizing agent.

7. A lifesaving pillow as recited in claim 1, in which said sheet material also includes a cloth layer as an outermost layer.

8. A lifesaving pillow as recited in claim 7, in which said sheet material also includes a cloth layer as an innermost layer.

* * * * *